US011204042B2

(12) United States Patent
Miwata et al.

(10) Patent No.: US 11,204,042 B2
(45) Date of Patent: Dec. 21, 2021

(54) VACUUM PUMP AND COOLING COMPONENT THEREOF

(71) Applicant: Edwards Japan Limited, Chiba (JP)

(72) Inventors: Toom Miwata, Chiba (JP); Yoshiyuki Takai, Chiba (JP); Yoshiyuki Sakaguchi, Chiba (JP)

(73) Assignee: EDWARDS JAPAN LIMITED, Chiba (JP)

( * ) Notice: Subject to any disclaimer, the term of this patent is extended or adjusted under 35 U.S.C. 154(b) by 0 days.

(21) Appl. No.: 17/057,940

(22) PCT Filed: May 30, 2018

(86) PCT No.: PCT/JP2018/020671
§ 371 (c)(1),
(2) Date: Nov. 23, 2020

(87) PCT Pub. No.: WO2019/229863
PCT Pub. Date: Dec. 5, 2019

(65) Prior Publication Data

US 2021/0207619 A1 Jul. 8, 2021

(51) Int. Cl.
*F04D 29/58* (2006.01)
*F04D 19/04* (2006.01)

(52) U.S. Cl.
CPC ..... *F04D 29/586* (2013.01); *F04D 19/04* (2013.01)

(58) Field of Classification Search
CPC ..... F04D 29/586; F04D 29/582; F04D 19/04; F04D 19/042
See application file for complete search history.

(56) References Cited

U.S. PATENT DOCUMENTS 7,753,661 B2 * 7/2010 Okudera ..... F04D 25/06 417/423.4
9,638,200 B2 * 5/2017 Tsutsui ..... F04D 29/5853
(Continued)

FOREIGN PATENT DOCUMENTS

JP H05989 U1 1/1993
JP 0886298 A 4/1996
(Continued)

OTHER PUBLICATIONS

PCT International Search Report dated Aug. 21, 2018 for corresponding PCT application Serial No. PCT/JP2018/020671, 2 pages.
(Continued)

*Primary Examiner* — Richard A Edgar
*Assistant Examiner* — Jackson N Gillenwaters
(74) *Attorney, Agent, or Firm* — Theodore M. Magee; Westman, Champlin & Koehler, P.A.

(57) ABSTRACT

A cooling component includes a plurality of port pairs, a flow path through which refrigerant flows, the refrigerant communicating with each of the ports of the plurality of port pairs, and a setting means for setting a usage pattern of the plurality of port pairs. The plurality of port pairs are provided along a circumferential direction of the casing. The setting means sets a selected port pair such that the refrigerant is supplied from outside into the flow path using the first port of the selected port pair and refrigerant is discharged from the flow path to outside using the second port of the selected port pair, and sets another port pair such that the refrigerant cannot be supplied from outside into the flow path or discharged from the flow path using the other port pair.

4 Claims, 8 Drawing Sheets

(56) References Cited

U.S. PATENT DOCUMENTS

| | | | | |
|---|---|---|---|---|
| 9,964,112 | B2 * | 5/2018 | Yamato | F04D 29/58 |
| 2012/0189472 | A1 * | 7/2012 | McDonald | B63G 8/001 417/372 |

FOREIGN PATENT DOCUMENTS

| | | | |
|---|---|---|---|
| JP | 2000303949 | A | 10/2000 |
| JP | 2001116016 | A | 4/2001 |
| JP | 2005083271 | A | 3/2005 |
| JP | 2008038764 | A | 2/2008 |
| JP | 2017194040 | A | 10/2017 |
| WO | 2005015026 | A1 | 2/2005 |
| WO | 2012053270 | A1 | 4/2012 |

OTHER PUBLICATIONS

PCT International Written Opinion dated Aug. 21, 2018 for corresponding PCT application Serial No. PCT/JP2018/020671, 2 pages.

* cited by examiner

VACUUM PUMP AND COOLING COMPONENT THEREOF

CROSS-REFERENCE OF RELATED APPLICATION

This application is a Section 371 National Stage Application of International Application No. PCT/JP2018/020671, filed May 30, 2018, which is incorporated by reference in its entirety and published as WO 2019/229863 A1 on Dec. 5, 2019.

BACKGROUND

The present invention relates to a vacuum pump used as a gas exhaust means for a process chamber or other vacuum chamber in a semiconductor manufacturing processing apparatus, a flat panel display manufacturing apparatus, and a solar panel manufacturing apparatus. The present invention is particularly suitable for precisely determining the need for pump maintenance.

As this type of vacuum pump, the vacuum pump described in, for example, WO2012/053270 or Japanese Patent Application Laid-open No. 2017-194040 has conventionally been known. This vacuum pump (referred to as "conventional vacuum pump," hereinafter) contains, in a casing thereof constituted of an outer cylinder 127, a base portion 129 and the like, a rotating body 103 and is structured to suck and exhaust gas by rotation of the rotating body 103.

In the conventional vacuum pump, in order to cool the vacuum pump a water cooling pipe 149 is installed as a cooling component in the base portion 129 constituting the casing.

However, according to the conventional vacuum pump, the water cooling pipe 149 is embedded in the base portion 129, and a cooling water supply/discharge port for supplying the cooling water to the water cooling pipe 149 and discharging cooling water from the water cooling pipe 149 is fixed at a predetermined position. Accordingly, when the vacuum pump is installed in a predetermined site, in some cases the position of the cooling water supply/exhaust port may not match the cooling piping layout of the site, and this hampers quick connection of a cooling pipe to a cooling component of the vacuum pump in accordance with the cooling piping layout of the site, as exemplified by difficulty of connecting the cooling pipe to the cooling water supply/discharge port on site, thereby impairing usability.

In the foregoing description, the reference numerals in the parentheses represent reference numerals used in WO2012/053270 or Japanese Patent Application Laid-open No. 2017-194040.

The discussion above is merely provided for general background information and is not intended to be used as an aid in determining the scope of the claimed subject matter. The claimed subject matter is not limited to implementations that solve any or all disadvantages noted in the background.

SUMMARY

The present invention has been contrived to solve the foregoing problems, and an object thereof is to provide a vacuum pump that is not only designed to enable quick connection of a cooling pipe to a cooling component of the vacuum pump according to a cooling piping layout of a site where the vacuum pump is to be installed, but also offer excellent usability. The object of the present invention is to also provide the cooling component of the vacuum pump.

In order to achieve the foregoing object, the present invention provides a vacuum pump sucking and exhausting gas by rotation of a rotating body, the vacuum pump including: a casing containing the rotating body; and a cooling component disposed on an outer periphery of the casing, wherein the cooling component has a plurality of port pairs including first and second ports, a flow path through which a refrigerant flows, the flow path communicating with each of the ports of the plurality of port pairs, and a setting means for setting a usage pattern of the plurality of port pairs, the plurality of port pairs are provided along a circumferential direction of the casing, and the setting means sets a selected port pair out of the plurality of port pairs such that the refrigerant can be supplied from outside into the flow path by using the first port of the selected port pair and such that the refrigerant can be discharged from the flow path to outside by using the second port of the selected port pair, and sets another port pair such that the refrigerant cannot be supplied from outside into the flow path by using the first port of the other port pair and such that the refrigerant cannot be discharged from the flow path to outside by using the second port of the other port pair.

Also, the present invention provides a cooling component of a vacuum pump, the cooling component being disposed on an outer periphery of a casing of the vacuum pump, wherein the cooling component comprises a plurality of port pairs including first and second ports, a flow path through which a refrigerant flows, the refrigerant communicating with each of the ports of the plurality of port pairs, and a setting means for setting a usage pattern of the plurality of port pairs, the plurality of port pairs are provided along a circumferential direction of the casing, and the setting means sets a selected port pair out of the plurality of port pairs such that the refrigerant can be supplied from outside into the flow path by using the first port of the selected port pair and such that the refrigerant can be discharged from the flow path to outside by using the second port of the selected port pair, and sets another port pair such that the refrigerant cannot be supplied from outside into the flow path by using the first port of the other port pair and such that the refrigerant cannot be discharged from the flow path to outside by using the second port of the other port pair.

In the present invention, a connecting pipe may be adopted as the setting means, wherein, when supplying the refrigerant from outside into the flow path and discharging the refrigerant from the flow path to outside by using the selected port pair out of the plurality of port pairs, the connecting pipe is mounted on another port pair that is not selected, and thereby connects the first port and the second port of the other port pair to make the first port and the second port of the other port pair communicate with each other.

In the present invention, an intermediate flow path and first and second plugs may be adopted as the setting means, the intermediate flow path has a plug insertion portion for insertion of the first plug and is configured to connect the first ports and the second ports configuring the plurality of port pairs such that the first ports and the second ports configuring the plurality of port pairs communicate with each other, the first plug is inserted into the plug insertion portion of the intermediate flow path by a predetermined insertion amount to function as a means for blocking the flow of the refrigerant in the intermediate flow path while preventing the refrigerant from flowing out of the plug insertion portion in accordance with the insertion amount, and to function as a means for maintaining the flow of the refrigerant in the intermediate flow path while preventing the refrigerant from flowing out of the plug insertion portion, and the second plug is mounted detachably on each of the first and second ports configuring the plurality of port pairs and, when mounted, functions as a means for prohibiting the refrigerant from flowing in and out via the first and second ports.

According to the present invention, specific configurations of the vacuum pump and the cooling component thereof adopt the configuration in which, as described above, a plurality of port pairs are provided along the circumferential direction of the casing. Accordingly, at the site where the vacuum pump is to be installed, one port pair corresponding to the cooling piping layout of the site can be selected from among the plurality of port pairs, and then a corresponding cooling pipe can be connected to the selected port pair, thereby realizing a vacuum pump that is not only designed to enable quick connection of a cooling pipe to the cooling component of the vacuum pump according to the cooling piping layout of the site, but also is easy to use, as well as the cooling component of the vacuum pump.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION

The best mode for carrying out the present invention is now described hereinafter in detail with reference to the accompanying drawings.

Figure 1:
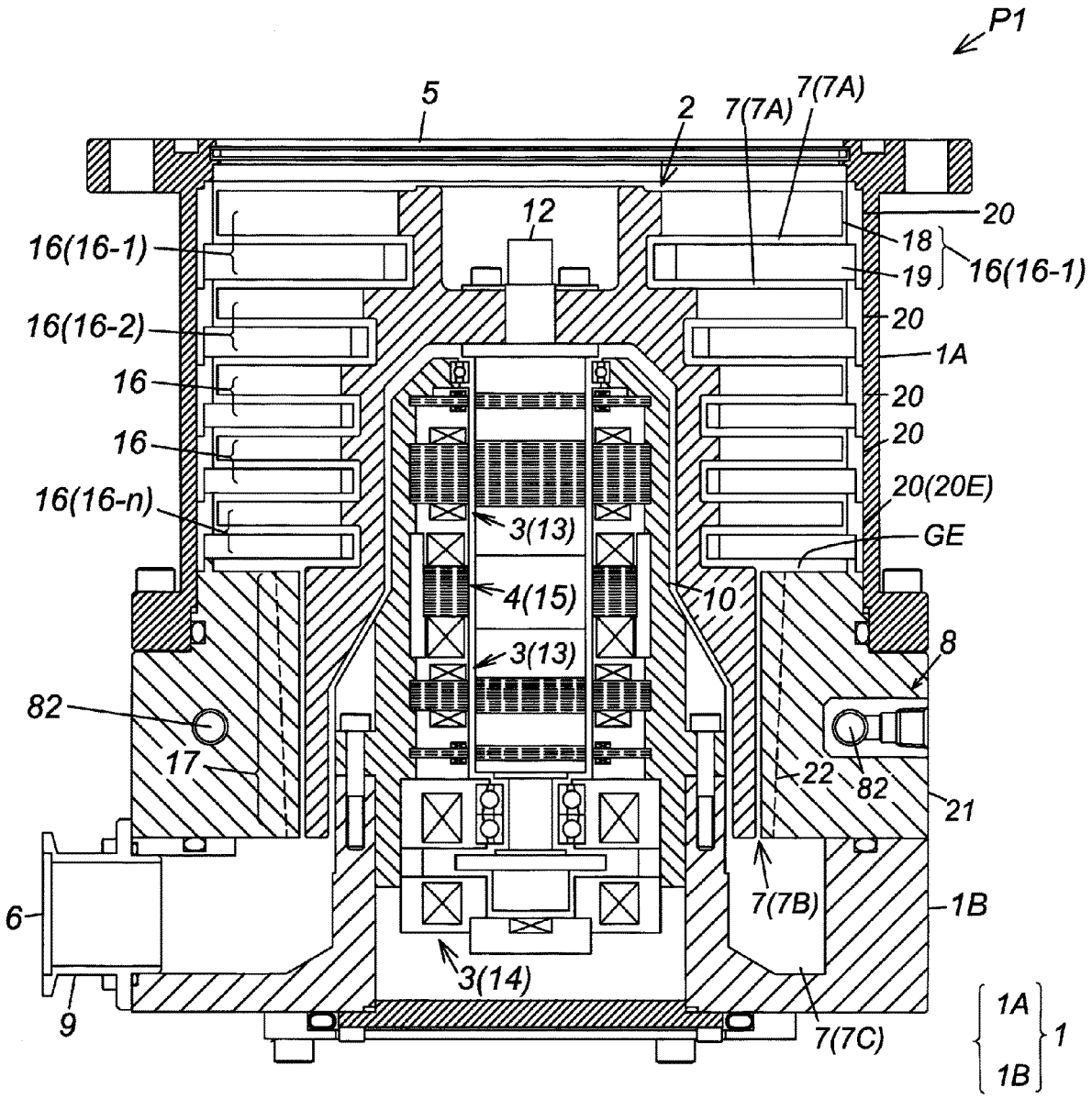
FIG. 1 is a cross-sectional view of a vacuum pump to which the present invention is applied.
Figure 2:
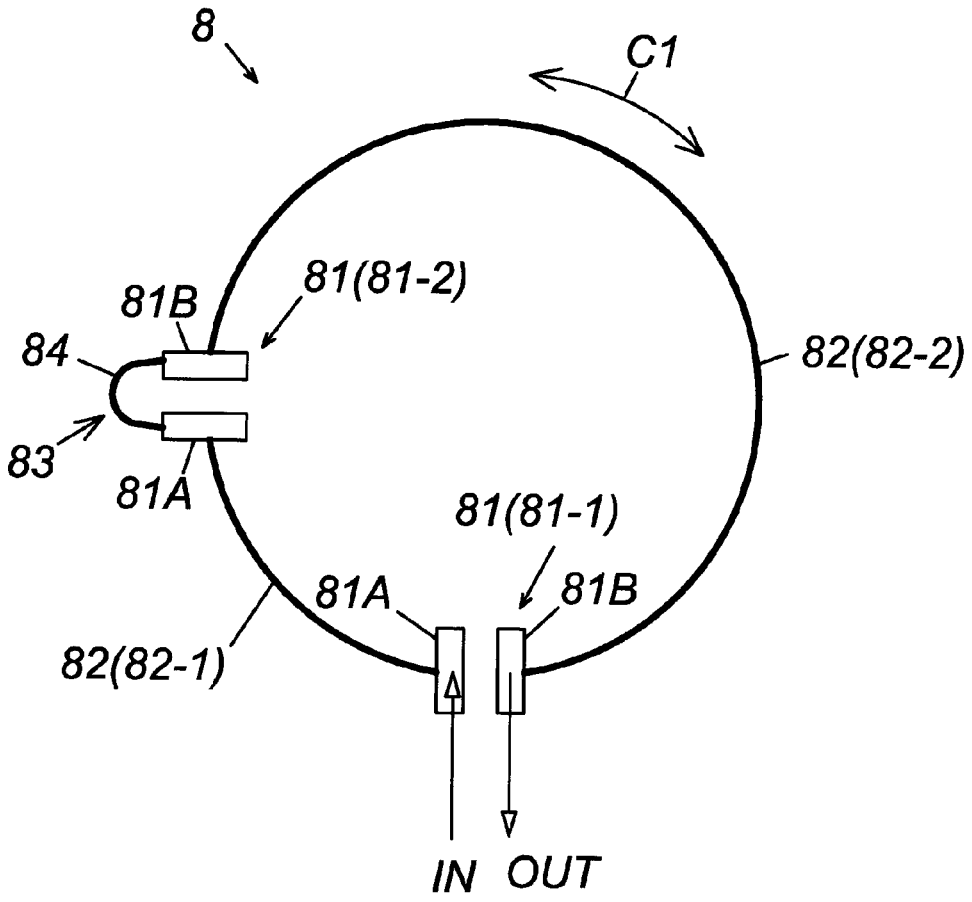
FIG. 2 is a first schematic drawing of a cooling component adopted in the vacuum pump shown in FIG. 1.

FIG. 1 is a cross-sectional view of a vacuum pump to which the present invention is applied. FIG. 2 is a first schematic drawing of a cooling component adopted in the vacuum pump shown in FIG. 1.

A vacuum pump P1 of FIG. 1 has a casing 1, a rotating body 2 housed in the casing 1, a support means 3 for rotatably supporting the rotating body 2, a drive means 4 for driving the rotating body 2 to rotate, an inlet 5 for sucking gas by means of rotation of the rotating body 2, an outlet 6 for exhausting the gas sucked from the inlet 5, a flow path 7 of the gas migrating from the inlet 5 toward the outlet 6 (referred to as "gas flow path," hereinafter), and a cooling component 8 disposed on an outer periphery of the casing 1. The vacuum pump P1 is structured to suck and exhaust the gas by rotation of the rotating body 2.

The casing 1 has a pump case 1A and a cylindrical pump base 1B located below the pump case 1A. An upper end portion of the pump case 1A is opened as the inlet 5. The inlet 5 is connected to a vacuum chamber (not shown) that is in a high vacuum, such as a process chamber of an apparatus executing predetermined processing in a vacuum environment, the apparatus being, for example, a semiconductor manufacturing apparatus.

An outlet port 9 is provided in a side surface of a lower end portion of the pump base 1B. One end of the outlet port 9 is communicated with the gas flow path 7, and the other end of the outlet port 9 is opened as the outlet 6. The outlet 6 is connected in a communication manner to an auxiliary pump which is not shown.

A stator column 10 is provided in the center of the pump case 1A. The stator column 10 is configured to rise from the pump base 1B toward the inlet 5. Various electrical components (see a drive motor 15 and the like described later) are attached to the stator column 10 having such a configuration. The vacuum pump P shown in FIG. 1 adopts a structure in which the stator column 10 and the pump base 1B are integrated as one component; however, the structure of the vacuum pump is not limited thereto. For example, although not shown, the stator column 10 and the pump base 1B may be configured as separate components.

The rotating body 2 is provided outside the stator column 10. Specifically, the stator column 10 is configured to be located inside the rotating body 2, and the rotating body 2 is enclosed in the pump case 1A and the pump base 1B and has a cylindrical shape so as to surround an outer periphery of the stator column 10.

A rotating shaft 12 is provided inside the stator column 10. The rotating shaft 12 is disposed in such a manner that an upper end portion thereof faces the inlet 5. The rotating shaft 12 is also rotatably supported by magnetic bearings (specifically, two pairs of known radial magnetic bearings 13 and a pair of known axial magnetic bearings 14). Furthermore, the drive motor 15 is provided inside the stator column 10, and the rotating shaft 12 is driven to rotate about the axis thereof by this drive motor 15.

The upper end portion of the rotating shaft 12 protrudes upward from a cylindrical upper end surface of the stator column 10, and an upper end of the rotating body 2 is integrally fixed to this protruding upper end portion of the rotating shaft 12 by fastening means such as bolts. The rotating body 2, therefore, is rotatably supported by the magnetic bearings (the radial magnetic bearings 13, the axial magnetic bearings 14) via the rotating shaft 12, and when the drive motor 15 is started in this supported state, the rotating body 2 can rotate integrally with the rotating shaft 12 around its axis. In other words, in the vacuum pump P1 shown in FIG. 1, the magnetic bearings function as support means for rotatably supporting the rotating body 2, and the drive motor 15 functions as a drive means for driving the rotating body 2 to rotate.

The vacuum pump P1 shown in FIG. 1 also has, between the inlet 5 and the outlet 6, a plurality of blade exhaust steps 16 that function as a means for exhausting gas molecules.

Also in the vacuum pump P1 shown in FIG. 1, a thread groove pump step 17 is provided downstream of the plurality of blade exhaust steps 16, that is, between the bottom blade exhaust step 16 (16-*n*) of the plurality of blade exhaust steps 16 and the outlet 6.

Details of Blade Exhaust Steps 16

The upstream side of the vacuum pump P1 of FIG. 1 from substantially the middle of the rotating body 2 functions as the plurality of blade exhaust steps 16. The plurality of blade exhaust steps 16 are described hereinafter in detail.

A plurality of rotor blades 18 that rotate integrally with the rotating body 2 are provided on an outer peripheral surface of the rotating body 2 that is located upstream from substantially the middle of the rotating body 2, and these rotor blades 18 are arranged radially at predetermined intervals around a rotation central axis of the rotating body 2 (specifically, the axis of the rotating shaft 12) or an axis of the casing 1 (referred to as "pump axis," hereinafter), for the respective blade exhaust steps 16 (16-1, 16-2, . . . 16-*n*). The rotor blades 18, due to the structure thereof, rotate integrally with the rotating body 2 and, therefore, are a constituent of the rotating body 2, hence when the rotating body 2 is described hereinafter, the rotating body 2 is meant to include the rotor blades 18.

On the other hand, a plurality of stator blades 19 are provided inside the casing 1 (specifically, on the inner peripheral side of the pump case 1A). The positions of the respective stator blades 19 in a pump radial direction and a pump axial direction are determined and fixed by a plurality of stator blade spacers 20 stacked in multiple stages on the pump base 1B. As with the rotor blades 18, these stator blades 19 are arranged radially at predetermined intervals around the pump axis, for the respective blade exhaust steps 16 (16-1, 16-2, . . . 16-*n*).

Specifically, a structure is formed in which the respective blade exhaust steps 16 (16-1, 16-2, . . . 16-*n*) are provided between the inlet 5 and the outlet 6 and the plurality of rotor blades 18 and stator blades 19 are arranged radially at predetermined intervals for the respective blade exhaust steps 16 (16-1, 16-2, . . . 16-*n*), thereby exhausting the gas molecules by means of these rotor blades 18 and stator blades 19.

Each of the rotor blades 18 is a blade-like cut product that is formed, by cutting, integrally with an outer diameter treated portion of the rotating body 2, and is inclined at an angle suitable for exhausting the gas molecules. Each of the stator blades 19 is also inclined at an angle suitable for exhausting the gas molecules.

Explanation of Exhaust Operation by Plurality of Blade Exhaust Steps 16

Of the plurality of blade exhaust steps 16 configured as described above, at the top blade exhaust step 16 (16-1), the plurality of rotor blades 18 are caused to rotate at a high speed integrally with the rotating shaft 12 and the rotating body 2 by starting the drive motor 15, and a downward, tangential momentum is imparted to the gas molecules that enter from the inlet 5, by an inclined surface of each rotor blade 18 that is tilted downward (the direction from the inlet 5 to the outlet 6, abbreviated as "downward," hereinafter) at front of the direction of rotation of the rotor blades 18. The gas molecules with this downward momentum are sent to the next blade exhaust step 16 (16-2) provided on the corresponding stator blade 19, by the opposite downward inclined surface in the direction of rotation of the rotor blades 18.

At the subsequent blade exhaust step 16 (16-2) and the following blade exhaust steps 16 as well, the rotor blades 18 rotate as in the top blade exhaust step 16 (16-1), whereby the momentum is applied to the gas molecules by the rotor blades 18 and the gas molecules are sent by the stator blades 19 as described above. In this manner, the gas molecules in the vicinity of the inlet 5 are sequentially shifted and exhausted toward the downstream side of the rotating body 2.

As can be seen from the gas molecules exhausting operation in the plurality of blade exhaust steps 16 described above, in the plurality of blade exhaust steps 16, gaps set between the rotor blades 18 and the stator blades 19 are configured into a flow path for exhausting the gas (referred to as "inter-blade exhaust flow path 7A," hereinafter).

Details of Thread Groove Pump Step 17

The downstream side of the vacuum pump P1 of FIG. 1 from substantially the middle of the rotating body 2 functions as the thread groove pump step 17. The thread groove pump step 17 is now described hereinafter in detail.

The thread groove pump step 17 has a thread groove exhaust portion stator 21 as a means for forming a thread groove exhaust flow path 7B at the outer peripheral side of the rotating body 2 (specifically, at the outer peripheral side of a downstream part of the rotating body 2 from substantially the middle of the rotating body 2). According to a specific configuration example of the thread groove exhaust portion stator 21, in the vacuum pump P1 in FIG. 1 the thread groove exhaust portion stator 21 constitutes a part of the casing 1 by being interposed, as a fixed component of the vacuum pump P1, between the pump case 1A and the pump base 1B; however, the specific configuration example of the thread groove exhaust portion stator 21 is not limited thereto. For example, in the structure in which the pump case 1A and the pump base 1B are connected by fastening means such as bolts, the thread groove exhaust portion stator 21 may be disposed inside the pump base 1B.

The thread groove exhaust portion stator 21 is a cylindrical fixed member that is disposed in such a manner that an inner peripheral surface thereof faces the outer peripheral surface of the rotating body 2, the thread groove exhaust portion stator 21 being disposed so as to surround the downstream part of the rotating body 2 from substantially the middle of the rotating body 2.

The downstream part of the rotating body 2 from substantially the middle of the rotating body 2 is a part that rotates as a rotating member of the thread groove pump step 17, and is inserted/housed in the thread groove exhaust portion stator 21, with a predetermined gap therebetween.

A thread groove 22 in a tapered shape, the depth of which decreases toward the bottom, is formed in an inner peripheral portion of the thread groove exhaust portion stator 21. The thread groove 22 is formed in a spiral shape from an upper end to a lower end of the thread groove exhaust portion stator 21.

The thread groove exhaust flow path 7B for exhausting the gas is formed on the outer peripheral side of the rotating body 2 by the thread groove exhaust portion stator 21 having the thread groove 22 described above. Although not shown, the thread groove exhaust flow path 7B described above may be provided by forming the thread groove 22 in the outer peripheral surface of the rotating body 2.

In the thread groove pump step 17, since the gas is compressed and transferred by the thread groove 22 and the drag effect on the outer peripheral surface of the rotating body 2, the depth of the thread groove 22 is set to be the deepest at the upstream entrance side of the thread groove exhaust flow path 7B (a flow path open end in the vicinity of the inlet 5) and the shallowest at the downstream exit side (a flow path open end in the vicinity of the outlet 6).

The entrance of the thread groove exhaust flow path 7B (the upstream open end) is opened toward the exit of the inter-blade exhaust flow path 7A, that is, a gap between the stator blade 19 constituting the bottom blade exhaust step 16-*n* and the thread groove exhaust portion stator 21 (referred to as "final gap GE," hereinafter), whereas the exit of the thread groove exhaust flow path 7B (the downstream open end) is communicated with the outlet 6 through an in-pump outlet side flow path 7C.

By providing a predetermined gap between the lower end portion of the rotating body 2 or the thread groove exhaust portion stator 21 and the inner bottom portion of the pump base 1B (a gap going one circle around a lower outer periphery of the stator column 10, in the vacuum pump P1 shown in FIG. 1), the in-pump outlet side flow path 7C is formed so as to extend from the exit of the thread groove exhaust flow path 7B to the outlet 6.

Explanation of Exhaust Operation by Thread Groove Pump Step 17

The gas molecules that reach the final gap GE (the exit of the inter-blade exhaust flow path 7A) by being transferred by the exhaust operation by the plurality of blade exhaust steps 16 described above are transferred to the thread groove exhaust flow path 7B. The transferred gas molecules move toward the in-pump outlet side flow path 7C while being compressed from the transitional flow to the viscous flow by the drag effect generated by the rotation of the rotating body 2. The gas molecules that reach the in-pump outlet side flow path 7C flow into the outlet 6 and are exhausted to the outside of the casing 1 through the auxiliary pump which is not shown.

Explanation of Gas Flow Path 7 in Vacuum Pump P1

As is clear from the foregoing description, in the vacuum pump P1 shown in FIG. 1, the gas flow path 7 includes the inter-blade exhaust flow path 7A, the final gap GE, the thread groove exhaust flow path 7B, and the in-pump outlet side flow path 7C, wherein the gas is transferred from the inlet 5 toward the outlet 6 through this gas flow path 7.

Explanation of Cooling Component 8

The heat of the rotating body 2 (including the plurality of rotor blades 18) is radiated toward the stator blades 19 and stator blade spacers 20 and transferred from a bottom stator blade spacer 20E (20) toward the thread groove exhaust portion stator 21. Thus, in the vacuum pump P1 of FIG. 1, the cooling component 8 is incorporated in a part of the thread groove exhaust portion stator 21.

As shown in FIG. 2, the cooling component 8 has a plurality of port pairs 81 including first and second ports, a flow path 82 for a refrigerant (hereinafter, referred to as "refrigerant flow path 82") that communicates with ports 81A, 81B of the plurality of port pairs 81, and a setting means 83 for setting the usage pattern of the plurality of port pairs 81.

The plurality of port pairs 81 are provided along a circumferential direction Cl of the casing 1. In the example shown in FIG. 2, two port pairs 81 are provided, but the number of port pairs 81 is not limited to two and therefore can be increased as needed.

Also, in the example shown in FIG. 2, the two port pairs 81 are arranged radially along the pump radial direction from the pump axis of the vacuum pump P1, and, off the two port pairs 81, a port pair 81-2 is disposed at a position 90 degrees off a port pair 81-1 along the circumferential direction of the casing 1 around the pump axis. However, such an angular arrangement of the port pairs 81 can be changed appropriately as needed. The same is true in the case where there exist three or more port pairs 81.

Tips of the first and second ports 81A and 81B configuring each port pair 81 are opened so that the tips can be used as inlets and outlets (IN, OUT) of the refrigerant.

In a specific configuration of the refrigerant flow path 82, the cooling component 8 of FIG. 2 adopts a structure in which the first port 81A configuring the port pair 81-1 and the first port 81A configuring the port pair 81-2 are connected by a first pipe body 82-1, a structure in which the second port 81B configuring the port pair 81-1 and the second port 81B configuring the port pair 81-2 are connected by a second pipe body 82-2, and a configuration in which the first and second pipe bodies 82-1 and 82-2 are used as the refrigerant flow path 82.

The setting means 83 functions as a means for setting one selected port pair 81-1 out of the plurality of port pairs 81 in such a manner that the refrigerant is supplied from the outside into the refrigerant flow path 82 using the first port 81A of the selected port pair 81-1 and that the refrigerant is discharged from the refrigerant flow path 82 to the outside using the second port 81B of the selected port pair 81-1, and a means for setting the other port pair 81-2 in such a manner as to prohibit both the supply of the refrigerant from the outside into the refrigerant flow path 82 using the first port 81A of the port pair 81-2 and the discharge of the refrigerant from the refrigerant flow path 82 to the outside using the second port 81B of the port pair 81-2.

Specific Configuration Example of Setting Means 83 (1)

FIG. 2 is a first schematic drawing of the cooling component adopted in the vacuum pump shown in FIG. 1.

As shown in FIG. 2, according to a specific configuration example for realizing the functions of the setting means 83 described above, the cooling component 8 of FIG. 2 adopts a connecting pipe 84. Note that FIG. 2 shows an example in which the port pair 81-1 is selected and used as the port pair to be used according to the cooling piping layout of the site where the vacuum pump P1 is to be installed.

When supplying the refrigerant from the outside into the refrigerant flow path 82 and discharging the refrigerant from the refrigerant flow path to the outside by using the port pair 81-1 selected from among the plurality of port pairs 81 (referred to as "selected port pair 81-1," hereinafter), the connecting pipe 84 is mounted on the port pair 81-2 that is not selected (referred to as "non-selected port pair 81-2"), and thereby connects the first port 81A and the second port 81B of the non-selected port pair 81-2 in a communication manner.

Accordingly, between the first port 81A and the second port 82B configuring the selected port pair 81-1, the first and second pipe bodies 82-1 and 82-2 are communicated with each other via the first and second ports 81A and 81B and the connecting pipe 84, the first and second ports 81A and 81B configuring the non-selected port pair 81-2.

The connecting pipe 84 functions as a pipe joint for coupling the first port 81A and the second port 81B to each other. Therefore, the connecting pipe 84 can be mounted on the non-selected port pair 81-2 by connecting one end of the connecting pipe 84 to the first port 81A and connecting the other end of the connecting pipe 84 to the second port 81B.

An external pipe is connected to the first and second ports 81A and 81B configuring the selected port pair 81-1 via a pipe joint (see reference numeral CN in FIG. 8) or the like. When the refrigerant is supplied from the connected external pipe to, for example, the first port 81A, the supplied refrigerant flows through the first pipe body 82-1, the first port 81A configuring the non-selected port pair 81-2, the connecting pipe 84, the second port 81B configuring the non-selected port pair 81-2, and the second pipe body 82-2, and is eventually discharged from the second port 81B configuring the selected port pair 81-1.

At this moment, mounting the connecting pipe 84 on the non-selected port 81-2 results in prohibiting both the supply of the refrigerant from the outside into the refrigerant flow path 82 using the first port 81A configuring the non-selected port pair 81-2 and the discharge of the refrigerant from the refrigerant flow path 82 to the outside using the second port 81B of the non-selected port pair 81-2.

The shape of the connecting pipe 84 is not limited to the U-shape shown in FIG. 2, and the material of the connecting pipe 84 may be a metal or an elastic member such as rubber. The shape and material of the connecting pipe 84 can be changed appropriately as needed.

Figure 3:
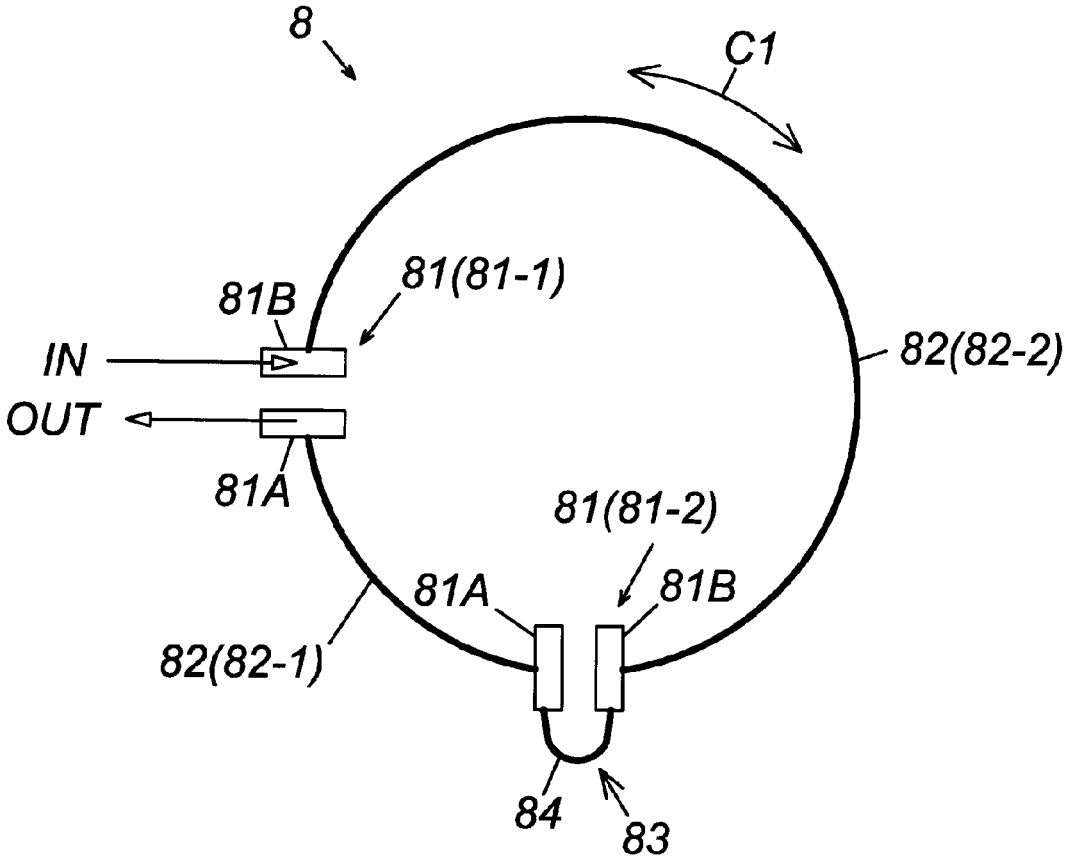
FIG. 3 is an explanatory diagram of an example of changing a port pair to be used in the cooling component of FIG. 2 in accordance with a cooling piping layout of a site where the vacuum pump is to be installed.

FIG. 3 is an explanatory diagram of an example of changing the port pair to be used in the cooling component 8 of FIG. 2 according to the cooling piping layout of the site where the vacuum pump P1 is to be installed. Specifically, FIG. 3 shows that the port pair 81-2 different from the port pair 81-1 selected in the example shown in FIG. 2 is selected and used as the port pair to be used.

When the port pair to be selected and used as in the example shown in FIG. 3 is changed from the example shown in FIG. 2, the connecting pipe 84 may be removed from the non-selected port pair 81-2 of FIG. 2, and then the removed connecting pipe 84 may be mounted on the selected port pair 81-1 of FIG. 2. In this case, the non-selected port pair 81-2 of FIG. 2 becomes the selected port pair 81-1 in FIG. 3, and the selected port pair 81-1 of FIG. 2 becomes the non-selected port pair 81-2 in FIG. 3.

Specific Configuration Example of Setting Means 83 (2)

Figure 4:
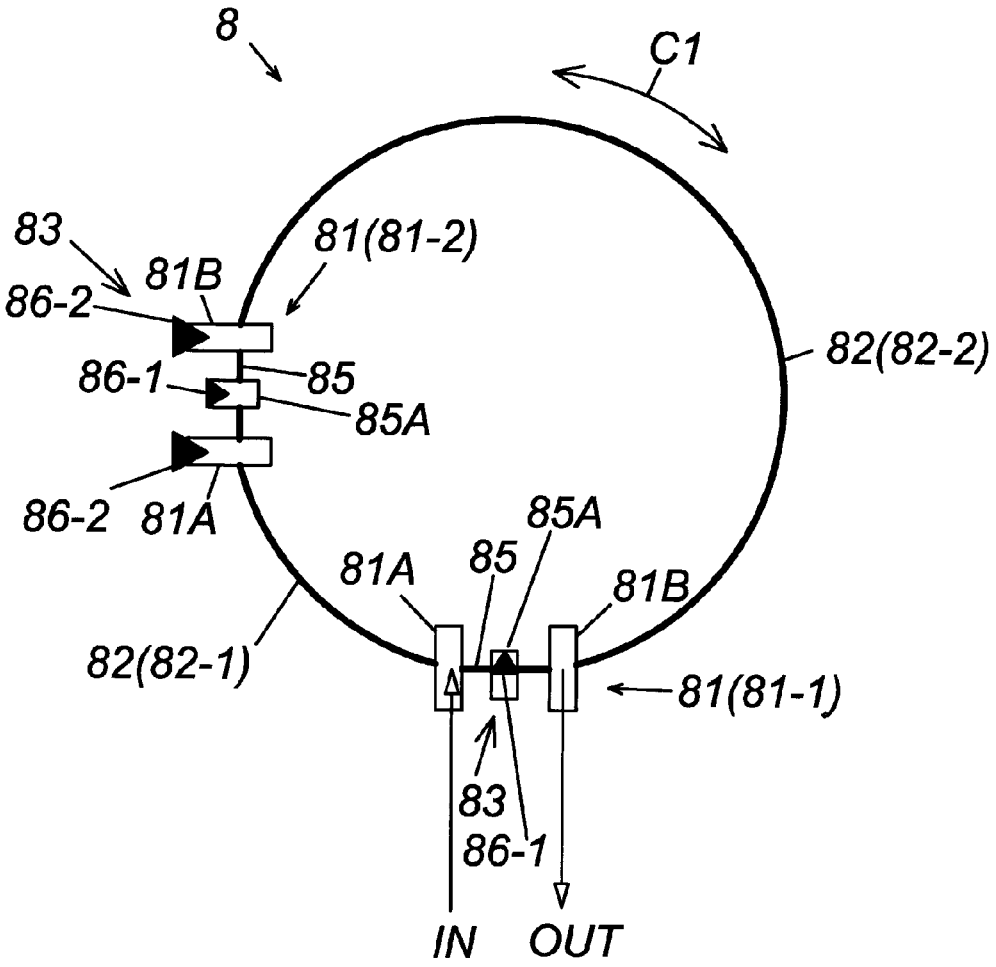
FIG. 4 is a second schematic drawing of the cooling component adopted in the vacuum pump shown in FIG. 2.
Figure 6:
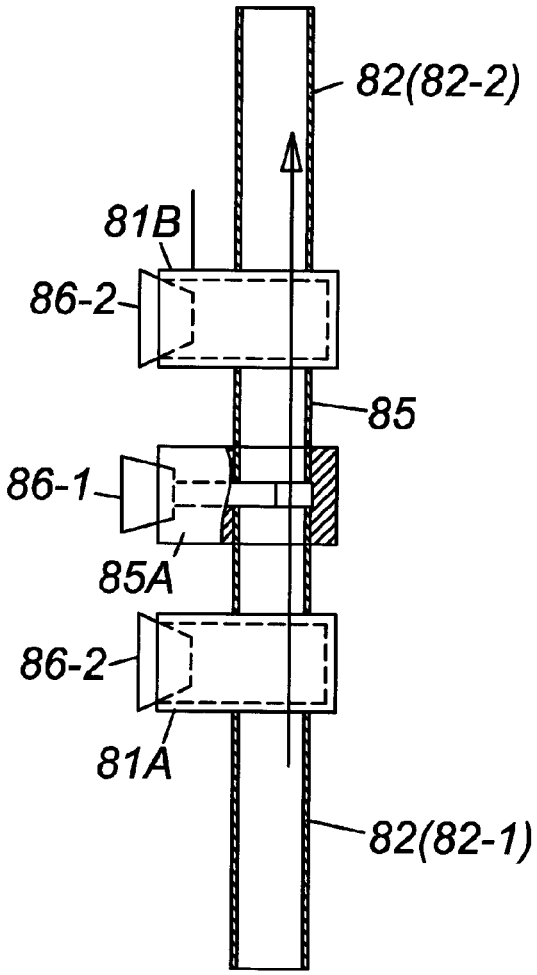
FIG. 6 is a partial cross-sectional schematic view of a first plug functioning as a stopper plug or a filler plug (a state in which the first plug functions as a filler plug)
Figure 7:
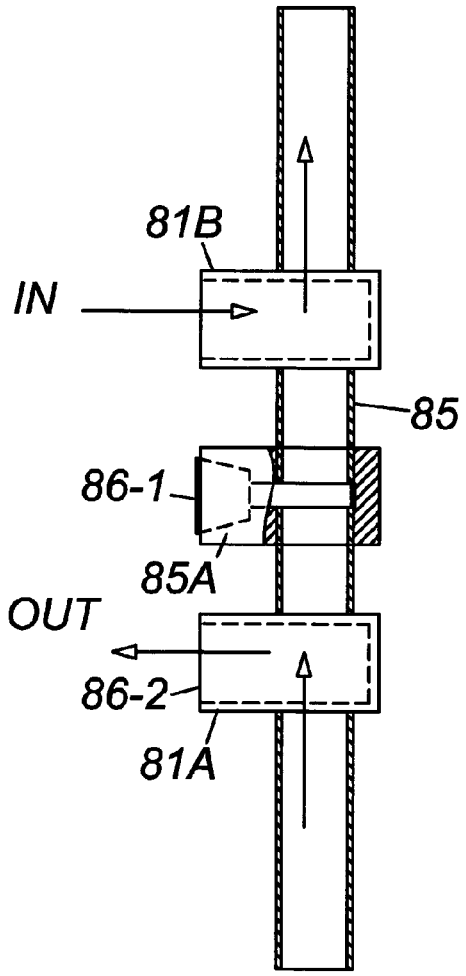
FIG. 7 is an explanatory diagram of an operation of the first plug shown in FIG. 6 (a state in which the first plug functions as a stopper plug)

FIG. 4 is a second schematic drawing of the cooling component adopted in the vacuum pump shown in FIG. 2. FIG. 6 is a partial cross-sectional schematic view of a first plug functioning as a stopper plug or a filler plug (a state in which the first plug functions as a filler plug). FIG. 7 is an explanatory diagram of an operation of the first plug shown in FIG. 6 (a state in which the first plug functions as a stopper plug).

As shown in FIG. 4, according to a specific configuration example for realizing the functions of the setting means 83 described above, the cooling component 8 of FIG. 4 adopts an intermediate flow path 85, and first and second plugs 86-1 and 86-2.

As shown in FIGS. 6 and 7, the intermediate flow path 85 has a plug insertion portion 85A for inserting the first plug 86-1 toward the flow path, and is communicated with the first port 81A and the second port 81B that configure the port pair 81.

The first plug 86-1 is inserted toward the intermediate flow path 85 in the plug insertion portion 85A by a predetermined amount, and thereby exhibits two functions in accordance with the insertion amount, i.e., a function as a means for stopping the flow of the refrigerant in the intermediate flow path 85 while preventing the refrigerant from flowing out of the plug insertion portion 85A (referred to as "stopper plug," hereinafter) (see FIG. 7), and a function as a means for allowing the refrigerant to flow in the intermediate flow path 85 while preventing the refrigerant from flowing out of the plug insertion portion 85A (referred to as "first filler plug," hereinafter) (see FIG. 6).

The second plug 86-2 is mounted detachably on each of the first and second ports 81A and 81B configuring the port pair 81. When mounted, the second plug 86-2 functions as a means for prohibiting the refrigerant from flowing in and out via the first and second ports 81A and 81B (referred to as "second filler plug," hereinafter).

As shown in FIG. 4, in the cooling component 8 of FIG. 4, the port pair 81-1 is selected as the port pair to be used according to the cooling piping layout of the site where the vacuum pump P1 is to be installed. In this case, in the selected port pair 81-1, the first plug 86-1 functions as the "stopper plug" described above (see FIG. 7). In the non-selected port pair 81-2, on the other hand, the first plug 86-1 functions as the "first filler plug" described above (see FIG. 6), and the second plug 86-2 functions as the "second filler plug" described above (see FIG. 6).

Therefore, when the external pipe is connected to the first and second ports 81A and 81B configuring the selected port pair 81-1 via the pipe joint or the like and when the refrigerant is supplied from the connected external pipe to, for example, the first port 81A, the supplied refrigerant flows through the first pipe body 82-1, the first and second ports 81A and 81B configuring the non-selected port pair 81-2, the intermediate flow path 85 communicating these ports, and the second pipe body 82-2, and is eventually discharged from the second port 81B configuring the selected port pair 81-1.

At this moment, in the non-selected port pair 81-2, since the second plug 86-2 is mounted on each of the ports 81A and 81B configuring the non-selected port pair 81-2, and since the first plug 86-1 inserted into the plug insertion portion 85A of the intermediate flow path 85 functions as a filler plug, the supply of the refrigerant from the outside into the refrigerant flow path 82 using the first port 81A configuring the non-selected port pair 81-2, the discharge of the refrigerant from the refrigerant flow path 82 to the outside using the second port 81B of the non-selected port pair 81-2, and flowing of the refrigerant in and out of the plug insertion portion 85A, are prohibited.

Figure 5:
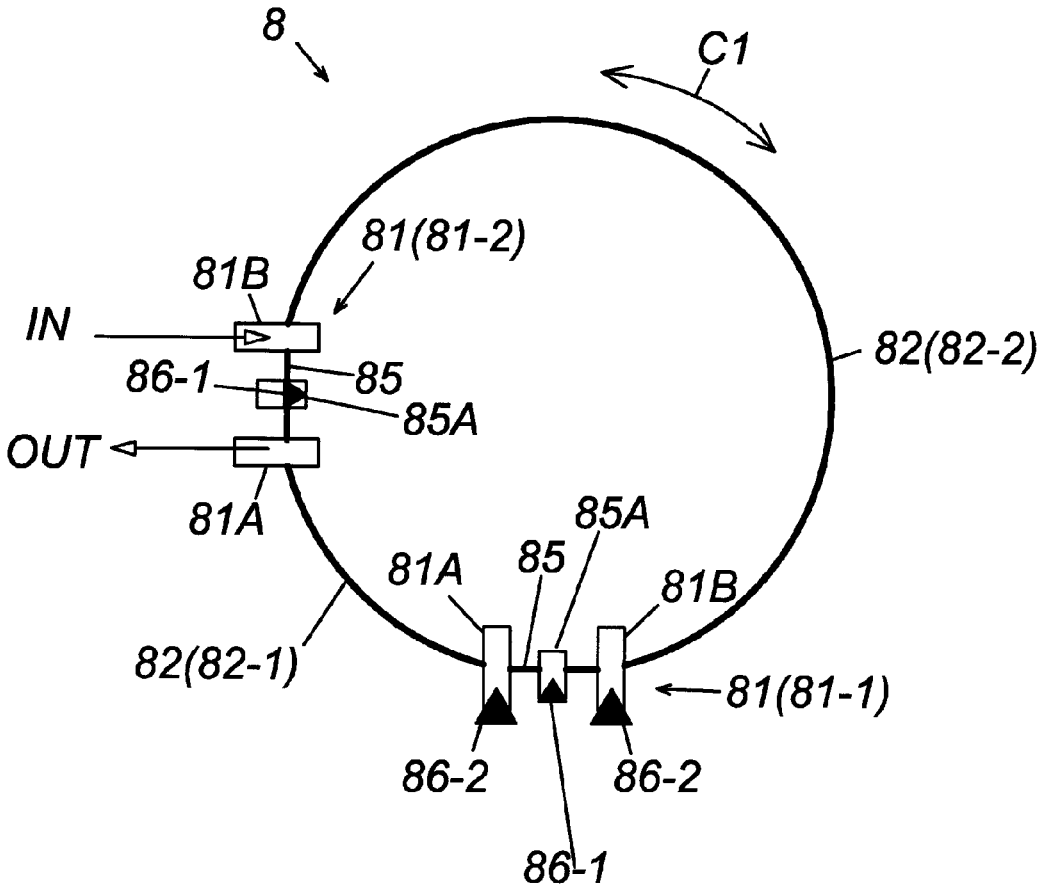
FIG. 5 is an explanatory diagram of an example of changing a port pair to be used in the cooling component of FIG. 4 in accordance with the cooling piping layout of the site where the vacuum pump is to be installed.

FIG. 5 is an explanatory diagram of an example of changing the port pair to be used in the cooling component 8 of FIG. 4 according to the cooling piping layout of the site where the vacuum pump P1 is to be installed. Specifically, FIG. 5 shows an example in which the port pair 81-2 different from the port pair 81-1 selected in the example shown in FIG. 4 is selected and used as the port pair to be used.

The port pair to be selected and used as in the example shown in FIG. 5 may be changed from the example shown in FIG. 4 in accordance with Procedure 1 and Procedure 2 described below.

Procedure 1

In the non-selected port pair 81-2 of FIG. 4, the second plug 86-2 that actually functions as the "second filler plug" is removed from each of the first and second ports 81A and 81B (see FIG. 5). Subsequently, the removed second plug 86-2 or a separately prepared second plug 86-2 is attached to each of the first and second ports 81A and 81B configuring the selected port pair 81-1 of FIG. 4 (see FIG. 5).

Procedure 2

In the non-selected port pair 81-2 of FIG. 4, the first plug 86-1 that actually functions as the "first filler plug" is set to function as a "stopper plug" (see FIG. 5). Then, in the selected port pair 81-1 of FIG. 4, the first plug 86-1 that actually functions as the "stopper plug" is set to function as the "first filler plug" (see FIG. 5).

Method for Incorporating Cooling Component 8

As a specific method for incorporating the cooling component 8 in the thread groove exhaust portion stator 21, the vacuum pump P1 shown in FIG. 1 adopts a method for embedding specific constituents of the cooling component 8

(the port pairs 81 and the refrigerant flow path 82 in the example shown in FIG. 2, and the port pairs 81, the refrigerant flow path 82, the intermediate flow path 85, and the plug insertion portion 85A in the example shown in FIG. 4) in the thread groove exhaust portion stator 21; however, the specific method is not limited thereto. The specific method for incorporating the cooling component 8 in the thread groove exhaust portion stator 21 can be changed appropriately as needed.

Figure 8:
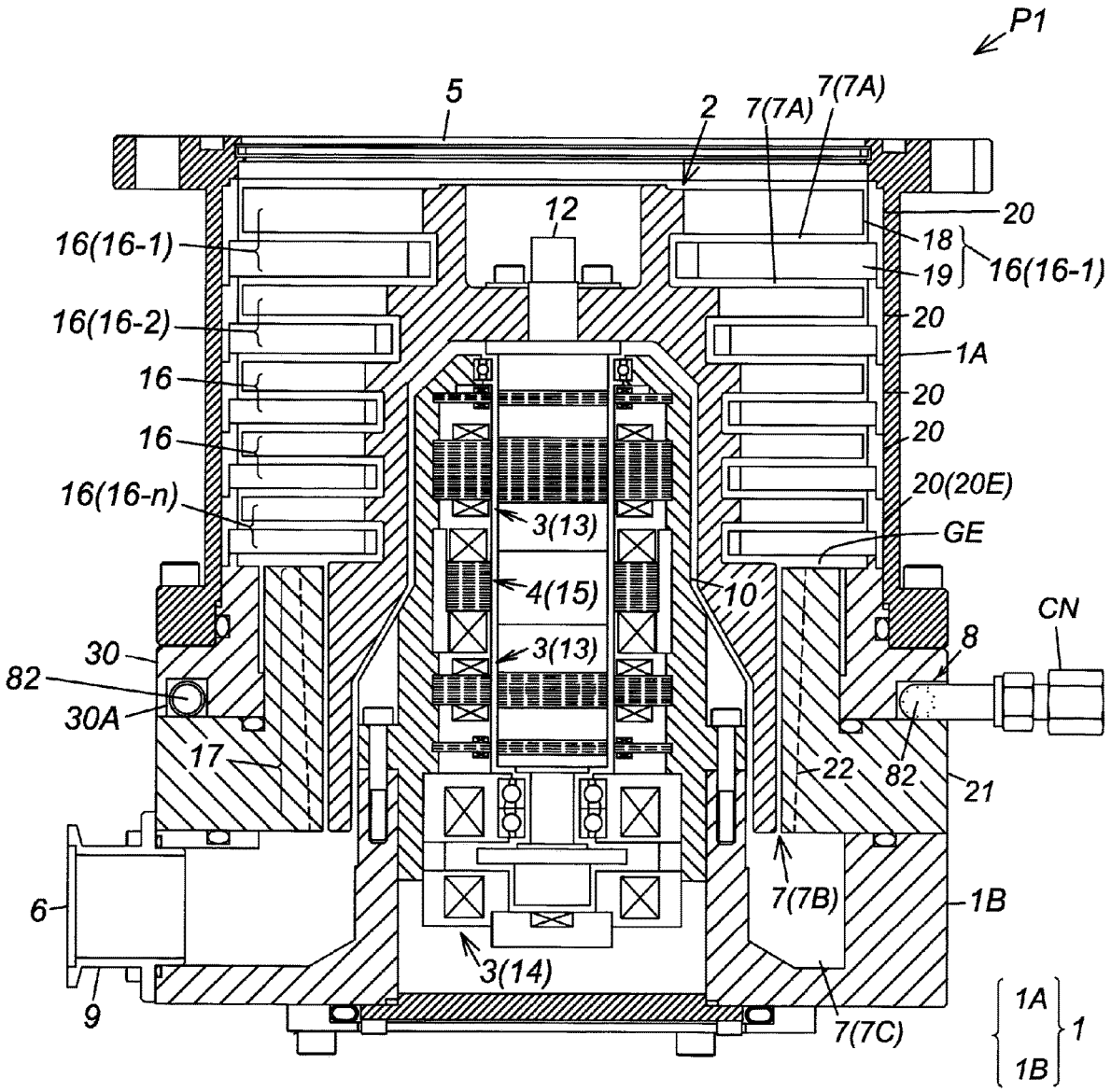
FIG. 8 is a cross-sectional view of another vacuum pump to which the present invention is applied.

For example, as in a vacuum pump P2 shown in FIG. 8, a part of the thread groove exhaust portion stator 21 may be configured as a separate component (refrigerant jacket 30), and then the specific constituents of the cooling component 8 described above may be installed in a groove portion 30A provided in the separate component (refrigerant jacket 30).

Effects

The vacuum pump and the cooling component thereof according to the foregoing embodiment adopt the configuration in which the plurality of port pairs are provided along the circumferential direction of the casing. Accordingly, at the site where the vacuum pump is to be installed, one port pair corresponding to the cooling piping layout of the site can be selected from among the plurality of port pairs, and then a corresponding cooling pipe can be connected to the selected port pair, realizing quick connection of a cooling pipe to the cooling component of the vacuum pump according to the cooling piping layout of the site, thus providing excellent usability.

The present invention is not limited to the foregoing embodiment, and many modifications can be made by those having ordinary knowledge in the art within the technical concept of the present invention.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump sucking and exhausting gas by rotation of a rotating body, the vacuum pump comprising:

a casing containing the rotating body; and a cooling component disposed on an outer periphery of the casing, wherein the cooling component has:

a plurality of port pairs including first and second ports;

a flow path through which a refrigerant flows, the flow path communicating with each of the ports of the plurality of port pairs; and a setting means for setting a usage pattern of the plurality of port pairs, the plurality of port pairs are provided along a circumferential direction of the casing, and the setting means sets a selected port pair out of the plurality of port pairs such that the refrigerant can be supplied from outside into the flow path by using the first port of the selected port pair and such that the refrigerant can be discharged from the flow path to outside by using the second port of the selected port pair, and sets another port pair such that the refrigerant cannot be supplied from outside into the flow path by using the first port of the other port pair and such that the refrigerant cannot be discharged from the flow path to outside by using the second port of the other port pair.

2. The vacuum pump according to claim 1, wherein a connecting pipe is adopted as the setting means, and when supplying the refrigerant from outside into the flow path and discharging the refrigerant from the flow path to outside by using the selected port pair out of the plurality of port pairs, the connecting pipe is mounted on another port pair that is not selected, and thereby connects the first port and the second port of the other port pair to make the first port and the second port of the other port pair communicate with each other.

3. The vacuum pump according to claim 1, wherein an intermediate flow path and first and second plugs are adopted as the setting means, the intermediate flow path has a plug insertion portion for insertion of the first plug and is configured to connect the first ports and the second ports configuring the plurality of port pairs such that the first ports and the second ports configuring the plurality of port pairs communicate with each other, the first plug is inserted into the plug insertion portion of the intermediate flow path by a predetermined insertion amount to function as a means for blocking the flow of the refrigerant in the intermediate flow path while preventing the refrigerant from flowing out of the plug insertion portion in accordance with the insertion amount, and to function as a means for maintaining the flow of the refrigerant in the intermediate flow path while preventing the refrigerant from flowing out of the plug insertion portion, and the second plug is mounted detachably on each of the first and second ports configuring the plurality of port pairs and, when mounted, functions as a means for prohibiting the refrigerant from flowing in and out via the first and second ports.

4. A cooling component of a vacuum pump, the cooling component being disposed on an outer periphery of a casing of the vacuum pump, wherein the cooling component comprises:

a plurality of port pairs including first and second ports;

a flow path through which a refrigerant flows, the flow path communicating with each of the ports of the plurality of port pairs; and a setting means for setting a usage pattern of the plurality of port pairs, the plurality of port pairs are provided along a circumferential direction of the casing, and the setting means sets a selected port pair out of the plurality of port pairs such that the refrigerant can be supplied from outside into the flow path by using the first port of the selected port pair and such that the refrigerant can be discharged from the flow path to outside by using the second port of the selected port pair, and sets another port pair such that the refrigerant cannot be supplied from outside into the flow path by using the first port of the other port pair and such that the refrigerant cannot be discharged from the flow path to outside by using the second port of the other port pair.

* * * * *